US005492242A

United States Patent [19]

Gall

[11] Patent Number: 5,492,242

[45] Date of Patent: Feb. 20, 1996

[54] CONTAINER FOR FLUIDS OR FLUID-LIKE PRODUCTS

[76] Inventor: Karsten Gall, Blumenstrasse 35, 75233 Tiefenbronn, Germany

[21] Appl. No.: 151,843

[22] Filed: Nov. 15, 1993

[51] Int. Cl.[6] ..... B65D 23/08

[52] U.S. Cl. ..... 220/406; 220/461; 220/468; 220/454

[58] Field of Search ..... 220/468, 461, 220/402, 406

[56] References Cited

U.S. PATENT DOCUMENTS

| | | | |
|---|---|---|---|
| 2,936,941 | 5/1960 | Lewis | 220/468 |
| 3,009,601 | 11/1961 | Matsch | 220/468 |
| 3,423,004 | 1/1969 | Christensson | 220/461 |
| 4,765,019 | 8/1988 | Michaels et al. | 220/468 |

FOREIGN PATENT DOCUMENTS

| | | |
|---|---|---|
| 0492522A | 7/1992 | European Pat. Off. . |
| 4023909 | 1/1992 | Germany . |

*Primary Examiner*—Joseph M. Moy
*Attorney, Agent, or Firm*—Evenson McKeown Edwards & Lenahan

[57] ABSTRACT

Paint buckets and other sales packaging for paints, solvents and the like must be cleaned from contamination by residual amounts of the previous content before a reuse. A container according to the invention has protective layers which are applied to its container walls in several layers and which, starting from a detaching point, can be pulled off together with adhering contaminations so that the container can be reused again without any cleaning expenditures.

18 Claims, 2 Drawing Sheets

CONTAINER FOR FLUIDS OR FLUID-LIKE PRODUCTS

BACKGROUND AND SUMMARY OF THE INVENTION

This invention relates to a container for fluids or fluid-like products, particularly paint buckets, comprising a protective layer which is applied to the wall of the container and can be detached from the wall.

Containers of this type, which are usually constructed in the form of buckets or canisters, are used as sales packaging for paints, solvents, and the like. According to the Packaging Regulation, after using the respective content, a purchaser has the right to return the sales packaging to the seller for reuse, recycling or waste disposal.

However, at the time of the return, the containers are generally contaminated by residual amounts of the previous content so that the containers must be cleaned before their reuse or under certain circumstances a reuse of the container may not be possible at all.

A container of the initially mentioned type is therefore known (German Patent Document DE 40 23 908 A1), in which a plastic layer is provided as a coating which cannot be detached by the content for which the container is intended but can be detached by means of an aqueous washing agent. Such plastic materials which can be detached by means of aqueous washing agents are suitable for certain beverages but not for the storing of paints or solvents. The plastic layer which is washed off after the use must always be replaced before the container is used again, which requires high expenditures.

It is also known to provide containers with exchangeable foil bags or the like (German Patent Document DE 34 39 442 A1 or DE 40 33 236 A1). However, solutions of this type are unsuitable for containers used for receiving paints or solvents.

It is therefore an object of the invention to provide a container of the initially mentioned type in the case of which a replacement of a protective layer becomes superfluous in the event of a reuse. This object is achieved according to the invention by providing a container of the initially mentioned type comprising at least one additional protective layer, but particularly several protective layers which are applied to the container wall while one separating layer respectively is inserted between them, which protective layers can be detached from the wall starting from at least one detaching point.

In preferred embodiments, the detaching point can be formed to accommodate manual removal by including (i) a pre-perforated section of the protective layer, (ii) a section of inserted ripping yarn embedded in the protective layer, or (iii) a weakened section of the protective layer. Also, a knife could be used to cut the protective layer at its detaching point.

At the time of the return to the seller or the filler, the residues and contamination situated in the container can be removed together with the protective layer by a simple pulling-off or peeling off of the protective layer which was in contact with the container content from the direction of the detaching point, whereby the container is "cleaned" and can be reused. The container may be reused several times. When the container is not damaged, a new application of several protective layers may take place after all protective layers have been used up. The container can then be reused until it is worn out.

Advantageously, the at least one detaching point for the protective layer extends around the edge of an opening of the container. By means of the arranging of the detaching point on the edge of the container opening, this opening, when the container is closed, is also covered and protected by its closing device. Even when the container is open, the detaching point; at the opening edge is not directly accessible and is therefore secure with respect to an unintentional detaching.

In an advantageous further development of preferred embodiments of the invention, the protective layer extends along the interior wall as well as the exterior wall of the container. This ensures that, when the protective layer is detached, not only residues are removed which have remained in the interior of the container but also dirt on the outside of the container is removed.

The individual protective layers of the container advantageously consist of a plastic material, the respective separating layer containing a separating agent, such as talcum, silicon or mineral oil. Protective layers made of wax may also be provided and can be detached thermally or mechanically.

After the application of separating layers onto the container wall or onto an already applied protective layer, the protective layers may be applied by a simple spraying, by dipping or by deep-drawing.

Other objects, advantages and novel features of the present invention will become apparent from the following detailed description of the invention when considered in conjunction with the accompanying drawings.

DETAILED DESCRIPTION OF THE DRAWINGS

Figure 1:
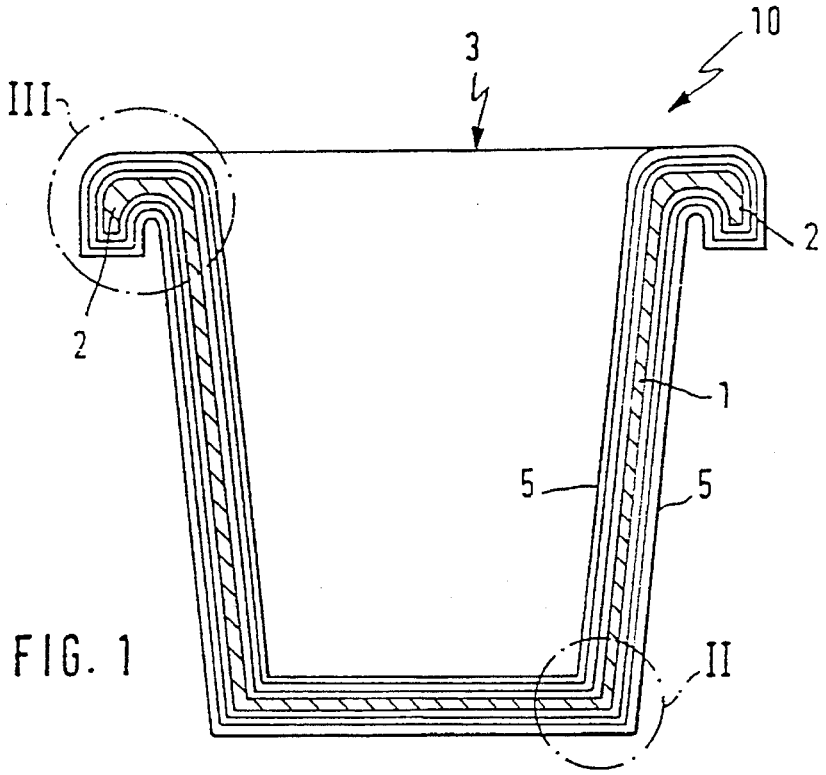
FIG. 1 is a sectional view of a container according to the invention in the shape of a bucket.

FIG. 1 is a schematic sectional representation of a container 10 according to the invention in the shape of a bucket with a container wall 1 which is constructed with a lid accommodating elevation 2 around an upward opening of the container. The container 10 has several protective layers 5 which are mounted in several layers on the interior side as well as on the exterior side of the container wall 1.

Figure 2:
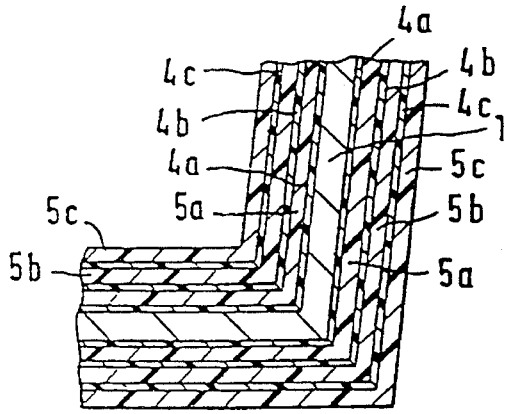
FIG. 2 is an enlarged cut-out II of FIG. 1.

For explaining the arrangement of the protective layers 5 on the container wall 1, FIG. 2 is an enlarged representation of a section from the bottom edge area of the bucket-shaped container 10 which is shown in FIG. 1 and has the symbol (II). With the insertion of a separating layer 4*a*, a first protective layer 5*a* is applied to the container wall 1 on the interior side as well as on the exterior side of the container resting closely against it. This first protective layer 5*a*, in turn, is separated by a separating layer 4*b* from another protective layer 5*b*. This layering is repeated by means of another separating layer 4*c* and again by means of another protective layer 5*c* so that the container wall 1 has toward both sides a sequence of separating layers 4 and protecting layers that alternates three times. As required, the individual protective layers 5*a*, 5*b*, 5*c* can be detached in one piece for the removal of contaminations of the container by being pulled off the container 10.

Figure 3:
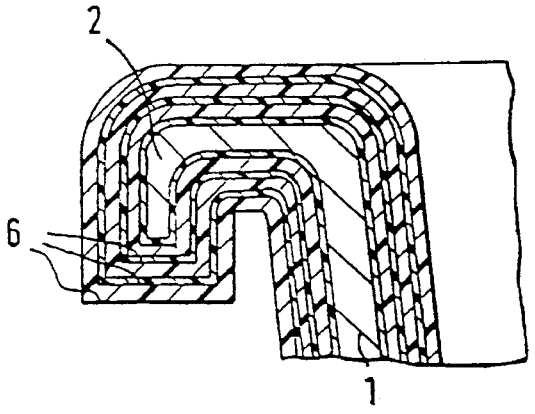
FIG. 3 is an enlarged cut-out III of FIG. 1.

For this purpose, a detaching point 6 is used at the lower edge of the lid elevation 2 which in FIG. 3 is represented as an enlargement of the cut-out (III) of FIG. 1. By detaching the corresponding most exterior protective layer at the detaching point 6, the protective layer can be gripped and can be removed from the container by being pulled off or peeled off. The detaching point 6 is arranged at the lower edge of the lid elevation 2 in such a manner that an unintentional detaching of the protective layers 5 is not possible but the detaching point 6 is easily accessible, as required. In this case, the detaching points 6 represent a connection between the respective protective layers of the interior side and the protective layers of the exterior side of the container.

Figure 4:
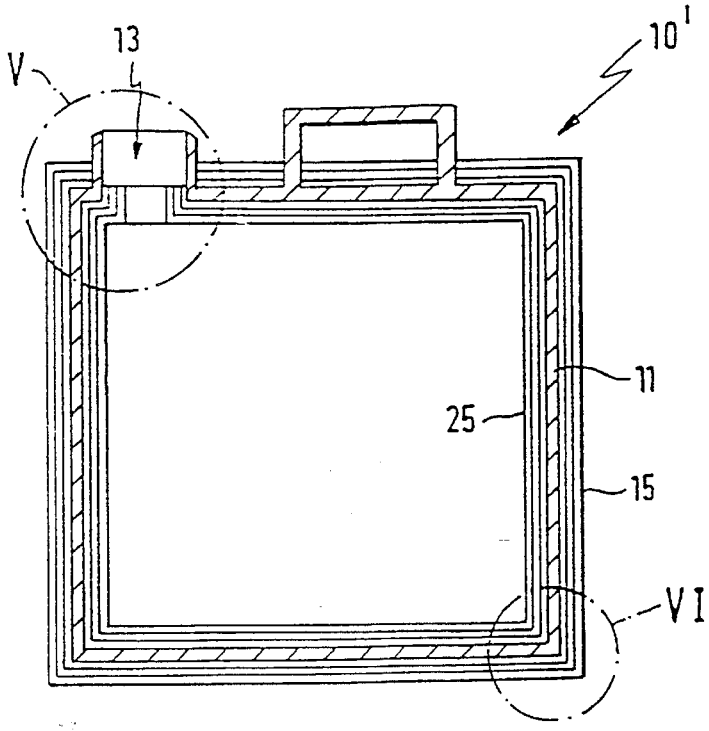
FIG. 4 is a sectional view of a container according to the invention in the shape of a canister.

In another embodiment of the invention, FIG. 4 illustrates in a schematic sectional representation a container 10' according to the invention in a canister shape. The canister shape of the container 10' is formed by a container wall 11 which has a vertical stub-shaped opening 13 in an upper horizontal area. On the exterior side of its container wall 11, the container 10' has protective layers 15 which are applied in several layers; on its interior side, it has protective layers 25 which are applied in several layers.

Figure 5:
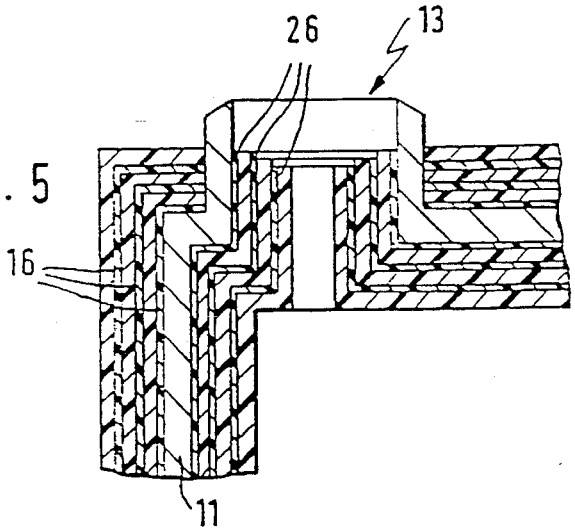
FIG. 5 is an enlarged cut-out V of FIG. 4.
Figure 6:
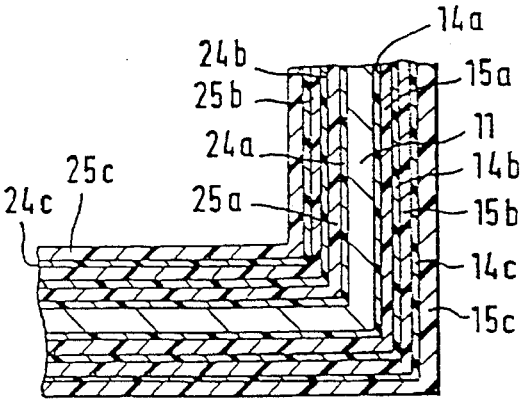
FIG. 6 is an enlarged cut-out VI of FIG. 4.

FIGS. 5 and 6 show the corresponding cut-outs (V) and (VI) of FIG. 4 in an enlarged representation. Along the container wall 11, first protective layers 15*a* and 25*a* are applied, with the insertion of a first separating layer 14*a* and 24*a* respectively on the exterior side as well as on the interior side. Again with the insertion of separating layers 14*b*, 14*c*; 24*b*, 24*c*, two additional protective layers 15*b*, 15*c* and 25*b*, 25*c* are applied to these first protective layers 15*a*, 25*a*. Advantageously, approximately five protective layers are applied to a container wall.

For detaching the protective layers, detaching points 16, 26 are arranged in the area of the stub-shaped opening 13 of the canister-shaped container 10'. The detaching points 16 for the protective layers 15 provided on the exterior side of the container wall 11 are situated on the exterior side of the stub 13; the detaching points 26 for the interior protective layers 25 are arranged directly on the interior wall below a screw-in thread of the stub opening 13. Also in the case of this embodiment, the detaching points 16, 26 are arranged so that they are protected from an unintentional activating, but are easily accessible, as required.

In preferred embodiments, the detaching points are formed to accommodate simple manual removal of the protective layer. Detaching points in the form of pre-perforated sections; or formed in ripping yarns; or formed in weakened sections are provided. In other embodiments a cutting tool can simply cut the protective layer at the detaching points to facilitate manual peeling off of the protective layer.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A container for paints and other fluid products, comprising:

container walls defining a container including an opening and interior and exterior walls;

a first separating layer applied to the container walls;

a first protective layer applied to the first separating layer;

a second separating layer applied to the first protective layer; and a second protective layer applied to the second separating layer, wherein each of said protective layers include at least one detaching point for facilitating detaching of the outermost protective layer to thereby remove the outermost protective layer and any contaminants thereon so that the container can be reused.

2. A container according to claim 1, wherein the at least one detaching point extends around on an edge of the opening of the container.

3. A container according to claim 1, wherein the protective layers extend along the interior wall and the exterior wall of the container.

4. A container according to claim 1, wherein the protective layers consist of plastic, and wherein the respective separating layers contain a separating agent for facilitating separation of the respective separating layers from the associated covering protective layers.

5. A container according to claim 4, wherein the separating agent is formed of one of talcum, silicon and mineral oil.

6. A container according to claim 1, wherein the protective layers consist of a paraffin wax, and wherein the separating layers include at least one of silicon oils, surface-active agents and long-chained alcohols.

7. A container according to claim 2, wherein the protective layers extend along the interior wall and the exterior wall of the container.

8. A container according to claim 7, wherein the protective layers consist of plastic, and wherein the respective separating layers contain a separating agent for facilitating separation of the respective separating layers from the associated covering protective layers.

9. A container according to claim 7, wherein the protective layers consist of a paraffin wax, and wherein the separating layers include at least one of silicon oils, surface-active agents and long-chained alcohols.

10. A container according to claim 1, further comprising more further sets of similar separating and protective layers on the container walls with a resultant total of five protective layers.

11. A container according to claim 1, wherein said detaching points include means for accommodating simple manual removal of respective protective layers.

12. A container according to claim 1, wherein said detaching points include pre-perforated sections.

13. A container according to claim 1, wherein said detaching points include ripping yarns.

14. A container according to claim 1, wherein said detaching points include formed in weakened sections.

15. A container according to claim 8, wherein said detaching points include means for accommodating simple manual removal of respective protective layers.

16. A container according to claim 8, wherein said detaching points include pre-perforated sections.

17. A container according to claim 8, wherein said detaching points include ripping yarns.

18. A container according to claim 8, wherein said detaching points include formed in weakened sections.

* * * * *